United States Patent [19]

Fiorenza, II

[11] Patent Number: 5,009,208

[45] Date of Patent: Apr. 23, 1991

[54] ENGINE SPEED LIMITER

[75] Inventor: John A. Fiorenza, II, Slinger, Wis.

[73] Assignee: Briggs & Stratton Corporation, Wauwatosa, Wis.

[21] Appl. No.: 568,654

[22] Filed: Aug. 14, 1990

Related U.S. Application Data

[63] Continuation of Ser. No. 482,006, Feb. 15, 1990, abandoned.

[51] Int. Cl.[5] ..... F02P 5/15

[52] U.S. Cl. ..... 123/335

[58] Field of Search ..... 123/334, 335, 198 DB, 123/198 DC, 352, 602, 418

[56] References Cited

U.S. PATENT DOCUMENTS

| | | | |
|---|---|---|---|
| 3,276,439 | 10/1966 | Reichenbach | 123/376 |
| 3,563,219 | 2/1971 | Mieras | 123/335 |
| 3,581,720 | 6/1971 | Hemphill | 123/335 |
| 3,601,103 | 8/1971 | Swiden | 123/335 |
| 3,767,972 | 10/1973 | Noddings et al. | 361/240 |
| 3,916,865 | 11/1975 | Kiencke et al. | 123/198 DB |
| 4,023,550 | 5/1977 | Houston | 123/198 D |
| 4,034,732 | 7/1977 | Van Burkleo | 123/198 DC |
| 4,058,094 | 11/1977 | Moore | 123/356 |
| 4,074,665 | 2/1978 | Patis | 123/335 |
| 4,237,997 | 12/1980 | Swanson | 180/272 |
| 4,252,096 | 2/1981 | Kennedy | 123/370 |
| 4,307,690 | 12/1981 | Rau et al. | 123/353 |
| 4,336,778 | 6/1982 | Howard | 123/334 |
| 4,491,105 | 1/1985 | Johansson | 123/335 |
| 4,531,489 | 7/1985 | Sturdy | 123/320 |
| 4,532,901 | 8/1985 | Sturdy | 123/333 |
| 4,625,689 | 12/1986 | Komurasaki | 123/335 |
| 4,664,080 | 5/1987 | Minks | 123/335 |
| 4,733,644 | 3/1988 | Staerzl | 123/335 X |
| 4,875,448 | 10/1989 | Dykstra | 123/352 |
| 4,884,541 | 12/1989 | Marriott | 123/361 |

FOREIGN PATENT DOCUMENTS

| | | | |
|---|---|---|---|
| 0025082 | 2/1984 | Japan | 123/335 |
| 0168274 | 9/1984 | Japan | 123/335 |

*Primary Examiner*—Willis R. Wolfe

*Attorney, Agent, or Firm*—Andrus, Sceales, Starke & Sawall

[57] ABSTRACT

An engine speed limiter includes a computing means for computing a value that is functionally related to the time between successive ignition pulses and for outputting a speed signal representative thereof. The speed limiter also includes generating means for generating a reference signal that is functionally related to the desired maximum limit speed. A comparison means compares the speed signal with the reference signal and generates a limit signal if the result of the comparison indicates that the actual engine speed is about equal to or greater than the desired maximum limit speed. The limit signal is used to interrupt engine ignition to thereby limit engine speed.

14 Claims, 4 Drawing Sheets

16
1 MHz INPUT
18
÷ 2048 FREQUENCY DIVIDER
488 Hz
20
÷ 7 FREQUENCY DIVIDER
69 Hz
22
LATCH
24
RESET
10
IGNITION INPUT CIRCUIT
12
INVERTER
14
÷ 2 FREQUENCY DIVIDER
30
AND
1
2
3
23
INVERTER
26
POSITIVE-GOING SQUARE WAVE
28
LATCH
31
LATCH
32
SWITCH
34
IGNITION PRIMARY WINDING
TERM 1
TERM 2

ENGINE SPEED LIMITER

This application is a continuation of application Ser. No. 482,006, filed Feb. 15, 1990, now abandoned.

BACKGROUND OF THE INVENTION

The present invention relates to speed limiters for internal combustion engines, and more particularly to speed limiters for small internal combustion engines of the type used mo power lawnmowers, snowblowers, generators and the like.

Conventional ignition apparatus for internal combustion engines comprises a primary and a secondary winding that are inductively coupled with one another, a spark plug connected across the terminals of the secondary winding, and control switch means for closing a circuit to enable current to flow in the primary winding and for opening that circuit at a time when the spark plug is to be fired. In battery ignition systems, the closing of the circuit that includes the control switch means allows battery current to flow in the primary winding. In a magneto ignition system, an electromagnetic field is induced in the primary winding by an orbitally moving magnet in cooperation with a fixed ferromagnetic core around which the primary and secondary windings are wound. The closing of the control switch means short-circuits the primary to allow current flow in it.

In either case, opening the primary circuit brings an abrupt change in a flux field with the secondary winding, thereby inducing a high voltage across the secondary and causing the spark plug to fire.

The conventional control switch means typically includes a pair of hard metal breaker points that are actuated by a mechanism having a cam that rotates in timed relation to the engine's cycle. More recently, the control switch means includes a semiconductor device such as a transistor, and a simple means for turning on and off the semiconductor device in timed relation to the engine's cycle.

It is often desirable to limit the speed of an engine to a predetermined maximum speed. Several types of electronic speed limiters are known. One type operates off the engine's alternator. Since the alternator typically provides a voltage proportional to the engine's speed, controlling the maximum voltage that may be reached by the alternator then controls the engine's maximum speed.

Electronic speed limiters are also known which are an integral part of the engine ignition system. Such speed limiters have the disadvantage that they cannot be easily retrofit onto an existing engine's ignition system without replacing at least a portion of the ignition system. Therefore, it is desirable to provide a simple engine speed limiter which may be retrofit onto an existing engine by connecting it to the engine's ignition system.

SUMMARY OF THE INVENTION

A speed limiter for an internal combustion engine having an ignition primary winding that outputs successive pulses is disclosed.

The speed limiter includes a computing means for computing a value that is functionally related to the time between successive ignition pulses and for outputting a speed signal representative thereof. The speed limiter also includes generating means for generating a reference signal that is functionally related to the desired maximum limit speed. A comparison means compares the speed signal with the reference signal and generates a limit signal if the result of the comparison indicates that the actual engine speed is about equal to or greater than the desired maximum limit speed. In a preferred embodiment, the limit signal is generated if the speed signal is greater than or about equal to the reference signal. The limit signal is used to interrupt engine ignition to thereby limit engine speed.

In a preferred embodiment, the computing means includes a determining means for determining the frequency of ignition pulses and for outputting a frequency signal related thereto. The computing means also includes a first frequency divider means for frequency dividing the frequency signal and for outputting a divided frequency signal, and an inverter that inverts the divided frequency signal and outputs the speed signal. The first frequency divider means may include at least one flip flop, with each flip flop being used as a divide-by-two frequency divider.

Also in the preferred embodiment, the generating means includes an input means for receiving a clock signal from the engine, and a second frequency divider means for frequency dividing the clock signal and for outputting the reference signal that is functionally related to the clock signal. The second frequency divider means may also include at least one flip flop, each flip flop being used a divide-by-two frequency divider.

The comparison means preferably includes a multiple input gate, such as an AND, NAND, or NOR gate, that receives the speed signal and the reference signal as inputs and outputs the limit signal if the result of the comparison indicates that the engine speed is greater than or about equal to the desired maximum limit speed. Typically, a limit signal will be output by the gate if both the speed signal and the reference signal are in the same high or low state when received by the gate.

The limit signal is received by a latch and output by the latch to a switch means. The switch means is activated by being gated on in response to the limit signal. A means for shorting the ignition primary winding when the switch means is activated is in circuit connection with the switch means. The first and second terminals of the primary winding can be shorted together when the switch means is activated, or the ignition pulse can be shorted to ground.

The switch means preferably includes a triac, although an SCR or another semiconductor switch may be used.

The preferred embodiment of the present invention is best implemented using a single integrated circuit chip.

It is a feature and advantage of the present invention to provide a simple and inexpensive engine speed limiter which may be retrofit onto an internal combustion engine.

It is another feature and advantage of the present invention to provide a precise electronic speed limiter that uses standard, off-the-shelf components.

These and other features and advantages of the present invention will be apparent to those skilled in the art from the following detailed description of a preferred embodiment and the attached drawings in which:

DETAILED DESCRIPTION

In the present invention, the time between successive ignition pulses is computed by a computing means and a speed signal is output. Since a negative-going ignition pulse is generated on each engine revolution, the time between successive ignition pulses is indicative of engine speed. The speed signal is compared with a reference signal generated by a generating means. The reference signal is functionally related to the desired maximum engine limit speed. A comparison means, here a three input AND gate, compares the speed signal with the reference signal and generates a limit signal if the speed signal is positive-going at the same time that the reference signal is positive, indicating that the actual engine speed is about equal to or greater than the desired maximum limit speed. The limit signal output of the AND gate is used to interrupt engine3 ignition for one or more revolutions of the engine to thereby limit engine speed.

In a preferred embodiment, four successive ignition pulses are grounded if an overspeed condition exists. The spark plugs are fired on the next two engine revolutions and the engine speed is again determined from the time between these ignition pulses. If the engine is still running above the maximum limit speed, the next four ignition pulses are grounded followed by spark plug firing for two engine revolutions. This pattern is repeated until the measured engine speed is below the desired maximum limit speed. Of course, the ignition pulses could be grounded for a different number of revolutions and still be within the scope of the present invention.

The fact that some—but not all—of the ignition pulses are grounded in the preferred embodiment gives the present invention a significant advantage over prior art speed limiters. Typical prior art devices grounded all ignition pulses until the engine speed was below the desired maximum limit speed. Fuel is still being pumped into the combustion chamber even though no combustion takes place. Fuel builds up in the engine, causing fuel vapors to auto-ignite on the hot muffler components. Such auto-ignition causes a lot of noise, may damage muffler components, and may injure the operator due to flying muffler debris.

Auto-ignition of fuel vapor is avoided in the present invention since fuel combustion in the combustion chamber is still taking place after four or another number of ignition pulses are grounded to slow the engine speed.

Figure 1:
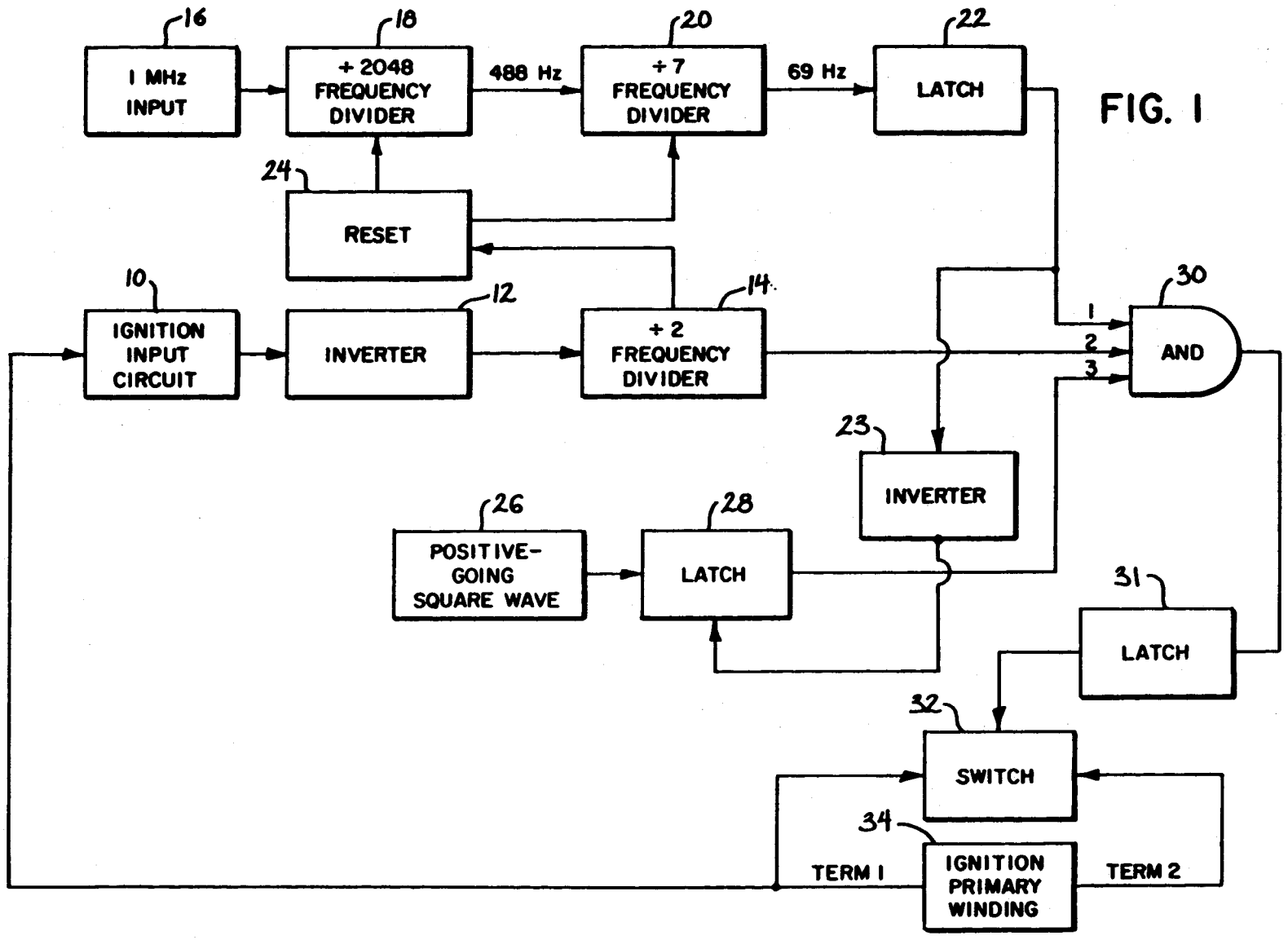
FIG. 1 is a flow diagram of the engine speed limiter according to the present invention.
Figure 3A:
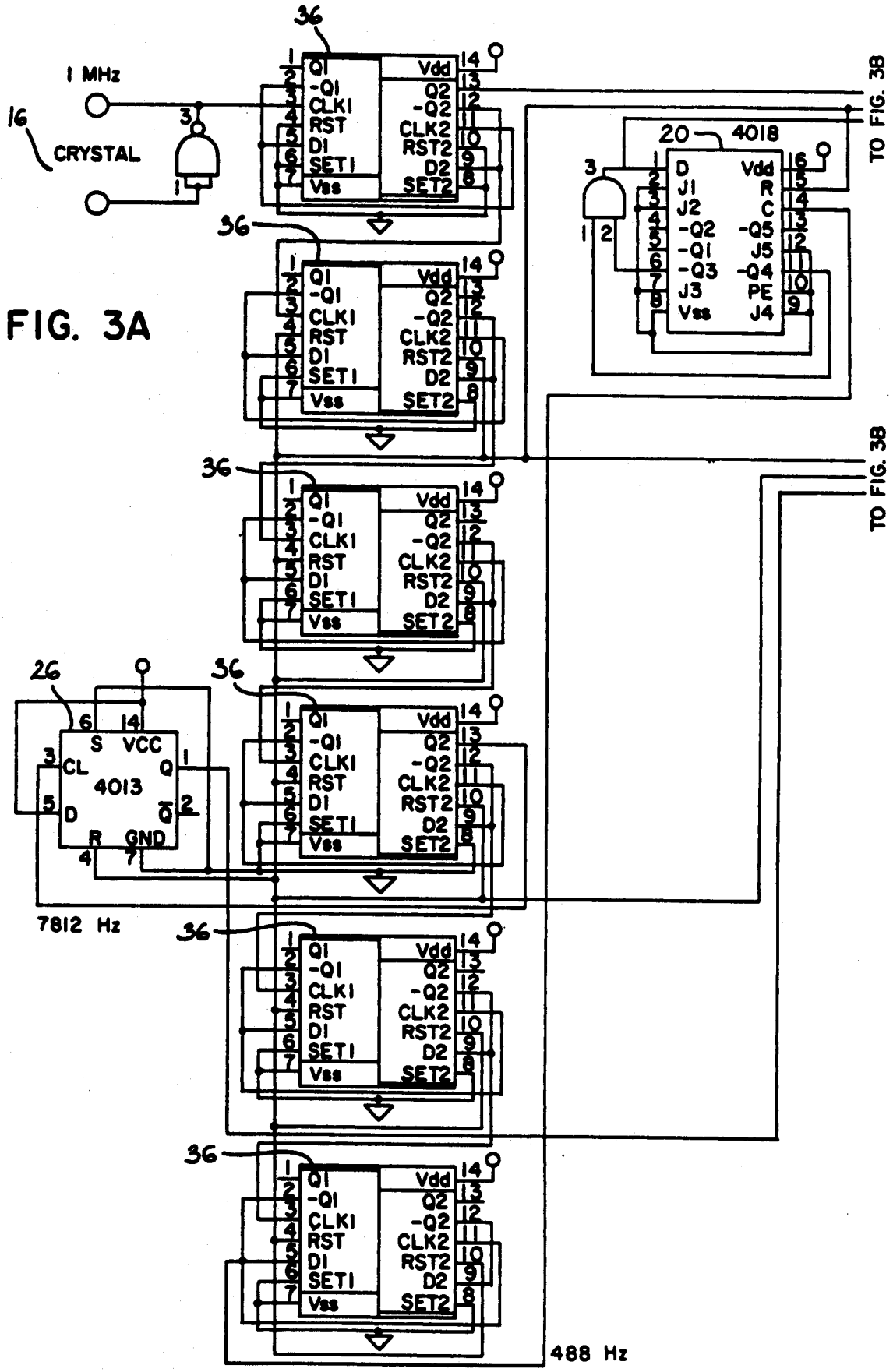
FIG. 3A and FIG. 3B together comprise a schematic diagram of the preferred embodiment of the present invention using a single integrated circuit chip.
Figures 3B, 3C:
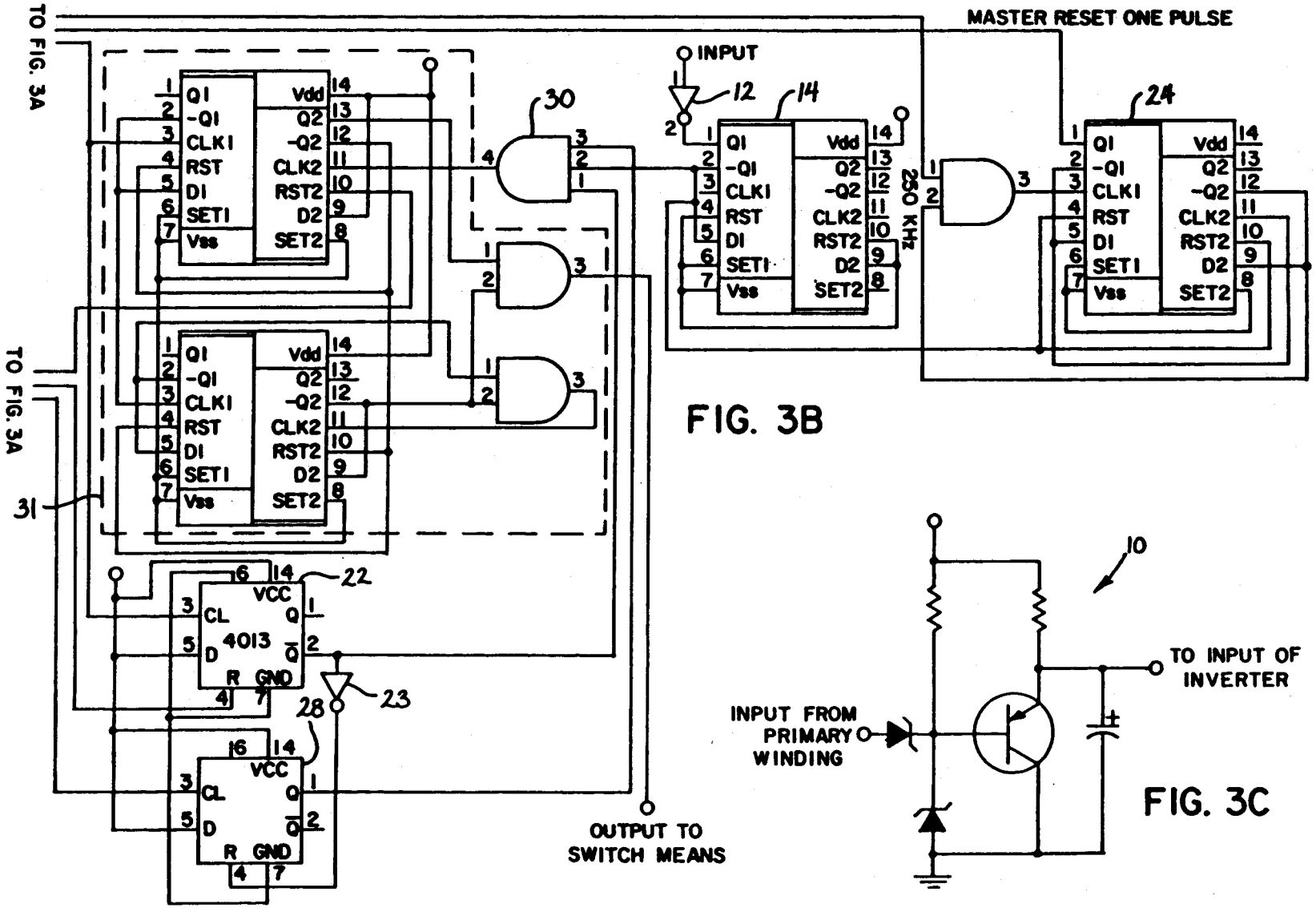
FIG. 3C is an ignition input circuit suitable for use with the circuit depicted in FIG. 3B.

FIG. 1 is a flow diagram relating to the preferred embodiment of the present invention. In FIG. 1, a computing means for outputting a speed signal that is functionally related to the time between successive ignition pulses and thus the engine speed consists of an ignition input circuit 10, an inverter 12, and a first frequency divider means 14. Ignition input circuit 10 and inverter 12 together comprise a determining means for outputting a frequency signal that is related to the frequency of ignition pulses. The schematic for ignition input circuit 10 is depicted in FIG. 3C. First frequency divider means 14 is preferably a model 4013 flip flop which is made by Motorola and others, although other frequency dividers could be used.

A generating means for generating a reference signal functionally related to the maximum limit speed consists of a one MHz input 16 which outputs a clock signal to a second frequency divider means consisting of frequency dividers 18 and 20. One MHz input 16 is preferably a crystal oscillator. Frequency divider 18 is preferably comprised of a series of divide-by-two flip flops, each of which may be, for example a Motorola model 4013 flip flop. The flip flops are depicted in FIG. 3A and assigned number 36. Frequency divider 20 is preferably a model 4018 Divide-by-N divider such as that manufactured by Motorola. The generating means also includes a latch 22 which is preferably a model 4013 flip flop as well.

A reset 24 resets frequency dividers 18 and 20 in response to a signal received from the first frequency divider means 14.

The preferred embodiment also includes a positive-going square wave signal source 26 which outputs a positive square wave signal to latch 28.

The reference signal output by latch 22 is input to the first input of a three input AND gate 30. The second input to AND gate 30 is the divided frequency signal output by first frequency divider means 14. The third input to AND gate 30 is the latched positive-going square wave signal 26, whose function is to prevent erroneous outputs by AND gate 30 as more fully discussed below.

AND gate 30 could be replaced by another multiple input gate such as a NAND, NOR, or an OR gate. AND gate 30 could also be replaced by any other digital or analog device whose function is to compare the reference signal and a signal related to the actual speed of the engine.

If the three inputs to AND gate 30 are simultaneously positive, then it generates a limit signal to latch 31. The output of latch 31 then goes positive to turn on switch means 32. Switch means 32 is preferably a triac, although an SCR or another semiconductor or solenoid switch may be used.

The limit signal received by latch 31 activates switch 32 by gating on or closing switch means 32.

Ignition primary winding 34 is inductively coupled with a secondary winding (not shown) to which at least one spark plug (not shown) is connected. Ignition primary winding 34 outputs a positive-going pulse for each revolution of the engine. After each positive-going pulse, the engine's ignition system causes the magnetic flux field in ignition primary winding 34 to collapse, resulting in a highly negative-going pulse to be generated by ignition primary winding 34. This negative-going voltage signal causes the spark plug to fire.

Ignition primary winding 34 has two terminals. The first terminal, term 1 in FIG. 1, is connected as one input to switch means 32. The second terminal, designated term 2 in FIG. 1, is connected to a second input of switch means 32. When switch means is gated on or closed, the first and second terminals of ignition primary winding 34 are then directly connected or shorted to each other, preventing the highly negative-going voltage pulse from being generated by ignition primary winding 34. Without this negative-going pulse, the spark plug cannot fire.

Ignition primary winding 34 also outputs winding pulses to ignition input circuit 10 which are used by the computing means to calculate the actual engine speed.

The operation of the engine speed limiter according to the present invention will be discussed with reference to the flow diagram of FIG. 1. In FIG. 1, ignition input circuit 10 receives a primary winding signal from winding 34 which is indicative of the frequency or speed of the engine. A frequency signal is output to an inverter 12 and is divided by two by frequency divider 14. The purpose of dividing the frequency signal by two is to average out the angular velocity of the engine flywheel during a single engine revolution. The flywheel has a higher angular velocity on its combustion half cycle than it has on its exhaust half cycle. The divided frequency signal is output by divider 14 to the second input of AND gate 30. Divider 14 also outputs a signal to reset 24 causing frequency divider 18 to reset and begin the counting cycle.

The generating means operates in the following manner. A 1 MHz signal is input from input 16 to frequency divider 18. Frequency divider 18 consists of a series of flip flops which together divide the 1 MHz signal by 2,048 to yield a 488 Hz output from divider 18. This output signal is further divided by seven by frequency divider 20, whose output is thus a 69 Hz signal to latch 22. Latch 22 then outputs a negative-going reference signal to the first input of AND gate 30.

A third input to AND gate 30 is used to prevent false outputs from AND gate 30 which may occur when both latch 22 and frequency divider 14 are changing state upon reset. When latch 22 is being reset by reset 24, its output changes state from negative to positive. At this time the output signal from divider 14 to AND gate 30 changes state from positive to negative. These devices may then output overlapping positive-going pulses which would otherwise result in a false limit signal being output by AND gate 30.

Source 26 outputs a 7,812 Hz signal which is latched by latch 28. The output of latch 28 goes positive 128 microseconds after the ignition input square wave goes low. This output is reset low by the inverted output signal of latch 22 by inverter 23. The output of latch 28 is the third input to AND gate 30.

The preferred embodiment disclosed herein is designed to limit engine speed when the engine speed reaches 4,185 revolutions per minute by grounding the ignition primary pulses for four revolutions. At the end of 4 revolutions, the circuit is reset and the spark plugs fire for 2 revolutions. If the speed is still greater than 4,185 RPM, the circuit will retrigger. The signal output by frequency divider 20 has a low to high transition 14.3 milliseconds after reset, corresponding to an engine speed of 4,185 RPM. This signal is latched low by latch 22, which is connected to the first input of AND gate 30. The reference signal is thus a 14.3 millisecond positive-going pulse.

After reset, the first input to AND gate 30 from latch 22 is positive. The third input to AND gate 30 from latch 28 goes positive 128 microseconds later. If the second input to AND gate 30 from divider 14 then goes positive, the ignition has fired again, indicating that the time between successive ignition pulses is too short. The engine is thus running too fast. The output of AND gate 30 then goes high, causing latch 31 to go high. This causes switch 32 to close and the ignition pulses to be grounded. Switch 32 is activated by being gated on or closing to short the first and second terminals of primary winding 34 to each other. This prevents primary winding 34 from outputting the high voltage negative pulse necessary to fire the spark plugs. In the alternative, either the secondary winding or the trigger coil in an inductive type of ignition may be grounded to prevent the spark plugs from firing. The charge winding or secondary winding on a capacitive discharge type of ignition may be grounded to prevent the spark plugs from firing.

The output of AND gate 30 will go and stay high for approximately four engine revolutions. During this time, divider 20 is still counting and clocking a series of three flip flops and the comparison means is not making any comparisons between the reference signal and the engine speed. After the three flip flops are clocked, the output from latch 31 is reset so that switch 32 opens and the spark plugs again fire for two engine revolutions. The entire limit system is reset on the next ignition pulse since frequency divider 14 outputs a signal to reset 24 which then outputs a reset signal to reset frequency dividers 18 and 20. After reset, the comparison means determines whether the engine speed still exceeds the desired maximum limit speed. If so, ignition pulses are again grounded for 4 engine revolutions.

Although a 1 MHz source is used to generate the reference signal, it is apparent that clock signal sources of other frequencies may be used. In fact, frequency dividers 18 and 20 may be eliminated altogether if the clock signal source outputs a signal having a frequency equal to that of the desired limit engine frequency or speed. In addition, the limit speed of 4,185 RPM is a desirable limit speed for small engines such as those used to power lawn mowers, snow blowers and the like. Other limit speeds may be used by varying the input clock signal and/or frequency dividers 18 and 20.

Other alternative apparatus and methods could be used to generate the limit signal which interrupts engine ignition. For example, the signal which is functionally related to engine speed could be run through one or more flip flops to yield a square wave output, or it could be run into an RC network to charge up a capacitor. In the latter case, the capacitor would charge up to a voltage that would be proportional to the amount of time between successive ignition pulses to provide an indication of engine speed.

In another alternate embodiment, the voltage generated at the spark plug gap itself could be used as an indication of engine speed since that voltage is relatively high when the spark plug fires once during each engine revolution.

As an alternative to the generating means, a set reference voltage signal could be used against which the capacitor output of the above-described RC network would be compared to determine if the engine had reached the limit speed. An analog comparator such as an operational amplifier could be used. The reference signal may be determined by the secondary winding voltage, or by the trigger winding voltage in a magneto-type of ignition system.

A key feature of the present invention is that pulses actually generated by the engine's ignition system are used by the computing means to compute engine speed. No intervening sensors like Hall effect sensors are needed. Some prior art automobile speed limiters use Hall sensors mounted near the crankshaft, cam shaft, or flywheel which output a signal every time the engine revolves, so that the time between successive outputs of the sensors is proportional to the engine speed. In addition to the extra sensor components needed for such systems, a battery or other power supply is needed to power the sensors. The engine speed limiter according to the present invention may be used with magneto-type ignition systems that do not have a battery power supply.

FIGS. 2A through 2J are timing diagrams depicting the pulses at various stages of the operation of the preferred embodiment as depicted in FIG. 1.

Figures 2A, 2B, 2C, 2D, 2E, 2F, 2G, 2H, 2I, 2J:
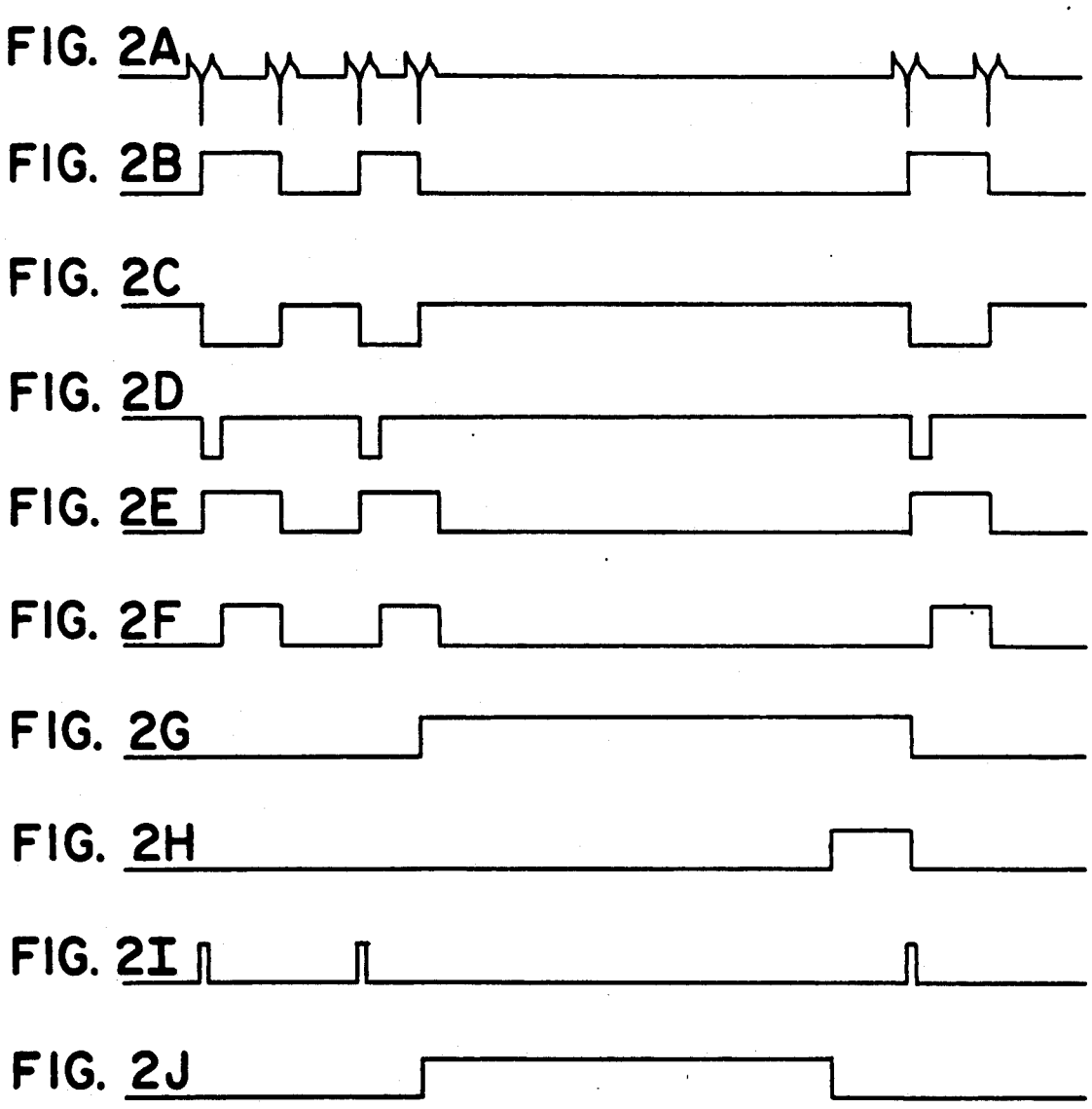
FIG. 2A is a diagram depicting pulses output by the ignition primary winding.
FIG. 2B is a timing diagram depicting the Q square wave output of divider 14 in FIG. 1.
FIG. 2C is a timing diagram depicting the $\overline{Q}$ square wave output of divider 14 in FIG. 1.
FIG. 2D is a timing diagram depicting the latched output of the 7812 Hz clock signal in FIG. 3.
FIG. 2E is a timing diagram depicting the ',ovs/Q/ square wave output of latch 22 in FIG. 1.
FIG. 2F is a timing diagram depicting the third input to the AND gate of FIG. 1.
FIG. 2G is a timing diagram depicting the output of the AND gate of FIG. 1.
FIG. 2H is the signal generated internal to latch 31 which goes high after three clock pulses from divider 20.
FIG. 2I is a timing diagram depicting the reset signal output by reset 24 in FIG. 1.
FIG. 2J is the signal output by latch 31 to switch 32.

FIG. 2A depicts successive positive, negative and positive pulses output by the ignition primary winding. The spark plug fires on the negative pulse. The engine speed is determined by computing the length of time between successive negative pulses. As depicted in FIG. 2A, no negative pulses are generated for a period of time because the pulse generated by latch 31, as depicted in FIG. 2J, is high during that time.

FIG. 2B depicts the positive-going pulses output at the Q output of frequency divider 14. FIG. 2C depicts the pulses output by frequency divider 14 which form the second input to AND gate 30. The width of the negative pulses in FIG. 2C correspond to the length of time between successive negative-going ignition pulses as depicted in FIG. 2A. FIG. 2C depicts the pulses output at the $\overline{Q}$ output of divider 14 which become the second input to AND gate 30. Thus, the pulses that are depicted in FIG. 2B are the inverted pulses depicted in FIG. 2C.

FIG. 2D is a timing diagram depicting the latched output of the 7,812 Hz clock signal in FIG. 3.

FIG. 2E is a timing diagram depicting the $\overline{Q}$ square wave output of latch 22 in FIG. 1. Thus, the pulses depicted in FIG. 2E become the first input to AND gate 30.

FIG. 2F depicts the third input to AND gate 30 of FIG. 1. Note that the pulses depicted in FIG. 2F are negative while the pulses forming the other two inputs to AND gate 30, depicted in FIGS. 2C and 2E, are changing state upon reset. This prevents erroneous positive-going outputs by AND gate 30 while the pulses depicted in FIGS. 2C and 2E are changing state as they are being reset.

FIG. 2G depicts the positive-going output of AND gate 30. The positive or high state output of AND gate 30 occurs when the three inputs to the AND gate, depicted in FIGS. 2C, 2E and 2F, are all positive.

FIG. 2H depicts the internal signal of latch 31 which causes it to be reset. It is the output of a string of three flip-flops. This string of flip-flops is closed by divider 20 when an overspeed condition exists.

FIG. 2I depicts the reset signal generated by reset 24 in FIG. 1 to reset frequency dividers 18 and 20 and to thereby restart the countdown by the generating means.

FIG. 2J is the output of latch 31 which controls switch 32.

FIGS. 3A and 3B together comprise a schematic diagram of the preferred embodiment of the present invention. The schematic in FIGS. 3A and 3B, as well as the circuit in FIG. 3C, correspond to the flow diagram depicted in FIG. 1. Components having corresponding functions to those depicted and described in connection with FIG. 1 have been given the same numerical designations in FIGS. 3A, 3B and 3C. The circuit depicted in FIG. 3C corresponds to ignition input circuit 10 in FIG. 1.

In FIG. 3A, flip flops 36 together comprise frequency divider 18 of FIG. 1.

Although a preferred embodiment of the present invention has been shown and described, other alternate embodiments will be apparent to those skilled in the art and are within the intended scope of the present invention. Therefore, the present invention is to be limited only by the following claims.

I claim:

1. A speed limiter for an internal combustion engine which has an ignition primary winding that outputs successive ignition pulses, said engine also having a capacitive discharge type of ignition system which includes a charge winding, said speed limiter comprising:
- computing means for outputting a speed signal functionally related to the time between successive ignition pulses;
- generating means for generating a reference signal functionally related to a maximum limit speed including:
  - input means for receiving a clock signal;
  - means for deriving said reference signal from said clock signal and for outputting said reference signal;
- comparison means for comparing said speed signal with said reference signal and for generating a limit signal if the result of said comparison indicates that the engine speed is about equal or greater than said maximum limit speed; and
- means for grounding said charge winding in response to said limit signal.

2. A speed limiter for an internal combustion engine which has an ignition primary winding that outputs successive ignition pulses, comprising:
- computing means for outputting a speed signal functionally related to the time between successive ignition pulses, said computing means including a capacitor that charges up to a voltage that is proportional to the amount of time between successive ignition pulses;
- generating means for generating a reference signal functionally related to a maximum limit speed, including:
  - input means for receiving a clock signal;
  - means for deriving said reference signal from said clock signal and for outputting said reference signal; and
- comparison means for comparing said speed signal with said reference signal and for generating a limit signal if the result of said comparison indicates that the engine speed is about equal to or greater than said maximum limit speed.

3. A speed limiter for an internal combustion engine which has a magneto-type of ignition system that includes a trigger winding and an ignition primary winding that outputs successive ignition pulses, said speed limiter comprising:

computing means for outputting a speed signal functionally related to the time between successive ignition pulses;

generating means for generating a reference signal functionally related to a maximum limit speed, including:

input means for receiving a clock signal;

means for deriving said reference signal from said clock signal and for outputting said reference signal;

comparison means for comparing said speed signal with said reference signal and for generating a limit signal if the result of said comparison indicates that the engine speed is about equal to or greater than said maximum limit speed; and means for grounding said trigger winding in response to said limit signal.

4. A speed limiter for an internal combustion engine which has an ignition primary winding that outputs successive ignition pulses, comprising:

computing means for outputting a speed signal functionally related to the time between successive ignition pulses;

generating means for generating a reference signal functionally related to the maximum limit speed including:

input means for receiving a clock signal;

means for deriving said reference signal from said clock signal and for outputting said reference signal; and comparison means for comparing said speed signal with said reference signal and for generating a limit signal for a preselected number of engine revolutions before the comparison means makes another comparison if the result of said comparison indicates that the engine speed is about equal to or greater than said maximum limit speed.

5. A speed limiter for an internal combustion engine which has an ignition primary winding that outputs successive ignition pulses, comprising:

computing means for outputting a speed signal functionally related to the time between successive ignition pulses;

generating means for generating a reference signal functionally related to a maximum limit speed, including:

input means for receiving a clock signal;

means for deriving said reference signal from said clock signal and for outputting said reference signal;

comparison means for comparing said speed signal with said reference signal and for generating a limit signal if the result of said comparison indicates that the engine speed is about equal to or greater than said maximum limit speed; and switch means for activating in response to said limit signal and for shorting said ignition primary winding.

6. The speed limiter of claim 5, wherein said switch means includes a triac.

7. A speed limiter for an internal combustion engine which has an ignition primary winding that outputs successive ignition pulses, comprising:

computing means for outputting a speed signal functionally related to the time between successive ignition pulses, including:

determining means for outputting a frequency signal functionally related to the frequency of ignition pulses;

first frequency divider means for frequency dividing said frequency signal and for outputting a divided frequency signal;

generating means for generating a reference signal functionally related to a maximum limit speed including:

input means for receiving a clock signal;

means for deriving said reference signal from said clock signal and for outputting said reference signal; and comparison means for comparing said speed signal with said reference signal and for generating a limit signal if the result of said comparison indicates that the engine speed is about equal to or greater than said maximum limit speed.

8. The speed limiter of claim 7, wherein said first frequency divider means includes a flip flop.

9. A speed limiter for an internal combustion engine which has an ignition primary winding that outputs successive ignition pulses, comprising:

computing means for outputting a speed signal functionally related to the time between successive ignition pulses;

generating means for generating a reference signal functionally related to a maximum limit speed, including:

input means for receiving a clock signal;

means for deriving said reference signal, including a second frequency divider means for frequency dividing said clock signal; and comparison means for comparing said speed signal with said reference signal and for generating a limit signal if the result of said comparison indicates that the engine speed is about equal to or greater than said maximum limit speed.

10. The speed limiter of claim 9, wherein said second frequency divider means includes a flip flop.

11. A speed limiter for an internal combustion engine which has an ignition primary winding that outputs successive ignition pulses, comprising:

computing means for outputting a speed signal functionally related to the time between successive ignition pulses, said computing means including determining means for outputting a frequency signal functionally related to the frequency of ignition pulses;

first frequency divider means for frequency dividing said frequency signal and for outputting a divided frequency signal; and an inverter that inverts said divided frequency signal and outputs said speed signal;

generating means for generating a reference signal functionally related to a maximum speed limit, said generating means including input means for receiving a clock signal;

second frequency divider means for frequency dividing said clock signal and for outputting said reference signal; and comparison means for comparing said speed signal with said reference signal and for generating a limit signal if the result of said comparison indicates that the engine speed is about equal to or greater than said maximum limit speed, said comparison means including:

a multiple input gate that receives said speed signal and said reference signal as inputs and which outputs said limit signal when both said speed signal and said reference signal are in the same state; and switch means for activating in response to said limit signal and for shorting said ignition primary winding.

12. The speed limiter of claim 11, wherein said switch means includes a triac.

13. The speed limiter of claim 11, wherein said first frequency divider means includes a flip flop.

14. The speed limiter of claim 11, wherein said second frequency divider means includes a flip flop.

* * * * *